US005937670A

United States Patent [19]

Derryberry

[11] Patent Number: 5,937,670

[45] Date of Patent: Aug. 17, 1999

[54] CHARGE BALANCE DEVICE

[75] Inventor: Andy L. Derryberry, Nashville, Tenn.

[73] Assignee: International Comfort Products Corporation (USA), Nashville, Tenn.

[21] Appl. No.: 08/948,341

[22] Filed: Oct. 9, 1997

[51] Int. Cl.[6] ..... F25B 13/00

[52] U.S. Cl. ..... 62/324.4; 62/174

[58] Field of Search ..... 62/324.4, 174

[56] References Cited

U.S. PATENT DOCUMENTS

| | | | |
|---|---|---|---|
| 2,715,317 | 8/1955 | Rhodes | 62/3 |
| 2,969,655 | 1/1961 | Salter | 62/324 |
| 3,110,164 | 11/1963 | Smith | 62/324 |
| 4,045,977 | 9/1977 | Oliver, Jr. | 62/324 |
| 4,137,726 | 2/1979 | Watada | 62/196 |
| 4,236,381 | 12/1980 | Imral et al. | 62/503 |
| 4,633,681 | 1/1987 | Webber | 62/324.6 |
| 4,655,051 | 4/1987 | Jones | 62/324 |
| 4,765,149 | 8/1988 | Shiga et al. | 62/324.4 |
| 5,784,892 | 7/1998 | Reedy | 62/174 |

FOREIGN PATENT DOCUMENTS

| | | | |
|---|---|---|---|
| 54-1475548 | 11/1979 | Japan | 62/324.6 |

*Primary Examiner*—Henry Bennett
*Assistant Examiner*—Melvin Jones
*Attorney, Agent, or Firm*—Baker & Daniels

[57] ABSTRACT

The present invention is a charge balance device for a heat pump. The heat pump system has a heating and a cooling mode and includes an indoor heat exchanger, an outdoor heat exchanger, a compressor, refrigerant circuitry connecting the heat exchangers and the compressor in series arrangement, with the charge balance device connected in parallel arrangement with the outdoor heat exchanger. An accumulator is connected in line with the refrigerant circuit at a point immediately upstream of the suction side of the compressor for storing excess liquid refrigerant during heating mode. The charge balance device includes a check valve for blocking refrigerant flow, thus preventing the diversion of refrigerant flow around the outdoor heat exchanger during cooling mode, and a restrictor orifice for throttling refrigerant flow, thus regulating the flow of refrigerant diverted around the outdoor heat exchanger during heating mode. The check valve and restriction orifice are integrally formed for diverting a regulated portion of liquid refrigerant around the outdoor heat exchanger during heating mode such that excess liquid refrigerant is allowed to be stored in the accumulator at a relatively low pressure.

6 Claims, 3 Drawing Sheets

COOLING MODE

COOLING MODE

HEATING MODE

FLOW DURING HEATING MODE

FLOW DURING COOLING MODE

CHARGE BALANCE DEVICE

BACKGROUND OF THE INVENTION

1. Field of the Invention

The present invention relates to heat pumps and more particularly to adjusting the effective charge of refrigerant in a heat pump system.

2. Background Art

Conventional heat pump systems generally employ a motor driven compressor for compressing refrigerant, a reversing valve for reversing the direction of refrigerant flow, two heat exchangers, either of which may function as a condenser or evaporator depending on the direction of refrigerant flow therethrough, an expansion device for controlling the flow of refrigerant into the evaporator, and an accumulator located on the low pressure, suction side of the compressor to trap incompressible liquid refrigerant slugs which could potentially damage components of the compressor. The heat exchangers are disposed in indoor and outdoor locations. Actuation of the reversing valve reverses the function of the heat exchangers, permitting the indoor heat exchanger to function as the evaporator for summertime cooling or as the condenser for wintertime heating, with the outdoor heat exchanger performing opposite functions.

Generally, it has been recognized in the art that optimum operation of a heat pump system during the cooling cycle requires a greater effective refrigerant charge than is required during the heating cycle. Because of the differing mass flow characteristics of refrigerant charge between the cooling and heating modes of the heat pump (i.e., a reduced amount of refrigerant charge is required during the heating mode), it is advantageous to include a holding area for the liquid refrigerant in excess of that required by the system. The holding area stores excess liquid refrigerant charge which otherwise might occupy a portion of the condenser during operation of the heating mode. Removing and storing excess liquid refrigerant allows for the use of a higher refrigerant charge during the cooling mode without causing excessive pressure build up in the condenser during the heating mode, thus resulting in increased cooling and heating efficiency.

Prior art methods used to compensate for the increased amount of refrigerant charge required during the cooling mode versus the heating mode are primarily directed to the inclusion of a fluid refrigerant receiver. The receiver inlet is generally disposed on the high pressure side of the expansion valve (with respect to the heating mode). During operation of the heating mode, high pressure fluid refrigerant is allowed to accumulate in the receiver. During the cooling mode, the liquid refrigerant is reintroduced into the refrigerant system as dictated by operating conditions.

A disadvantage associated with prior art systems employing a receiver to remove excess refrigerant is that they generally require a relatively large, high pressure reservoir and usually necessitate utilization of complex and expensive circuitry and valving schemes, which increase both capital costs and maintenance costs.

Another disadvantage associated with prior art systems relates to difficulties in adjusting the amount of liquid refrigerant to be removed from the system during the heating mode. Such systems remove an amount of liquid refrigerant equalling the volume of the receiver. The volume of the receiver is predetermined and if it is later desired to remove a lesser or greater amount of liquid refrigerant from the system, the effective volume of the receiver must be adjusted accordingly.

The prior art lacks a charge balance device for a heat pump system which removes and stores excess liquid refrigerant in a low pressure reservoir without employing complex and expensive circuitry and valving schemes, particularly one which may be easily and inexpensively installed into existing conventional heat pump systems.

SUMMARY OF THE INVENTION

The integral check valve and restrictor orifice overcomes the disadvantages of the above described prior art heat pump systems by providing an improved apparatus and method for automatically removing and storing excess refrigerant charge present in the system during operation of the heating mode and for restoring the excess refrigerant charge to the system during the cooling mode.

The heat pump system of the present invention includes indoor and outdoor heat exchangers, a compressor, refrigerant circuitry connecting the heat exchangers and the compressor in series arrangement, and a charge balance device connected in parallel arrangement with the outdoor heat exchanger for adjusting the amount of refrigerant charge circulating through the system by way of removing a portion of liquid refrigerant in excess of that required during the heating mode. An accumulator is optionally connected in line with the refrigerant circuit at a point immediately upstream of the suction side of the compressor for storing the excess fluid refrigerant.

More specifically, the charge balance device according to the present invention includes an integral check valve and restrictor orifice. The check valve blocks refrigerant flow, thus preventing the diversion of refrigerant flow around the outdoor heat exchanger during cooling mode. The restrictor orifice throttles refrigerant flow, thus regulating the flow of refrigerant diverted around the outdoor heat exchanger during heating mode. By diverting a regulated portion of liquid refrigerant around the outdoor heat exchanger during heating mode, excess liquid refrigerant is allowed to be stored in the accumulator at a relatively low pressure.

In one embodiment of the invention, the charge balance device is connected in parallel arrangement with the outdoor heat exchanger. One end of the charge balance circuit is connected to the refrigerant line connecting the indoor heat exchanger to the expansion valve at a point adjacent the expansion valve. The opposite end of the charge balance circuit is connected to the refrigerant line connecting the outdoor heat exchanger to the reversing valve at a point adjacent the outdoor heat exchanger inlet/outlet. The charge balance circuit is thus capable of diverting refrigerant flow around the outdoor heat exchanger.

It is an object of the present invention is to provide a device for automatically storing excess refrigerant charge present during the heating mode of a heat pump system byway of a simple, inexpensive apparatus and method.

It is a further object of the present invention to provide an improved charge controlling device for heat pumps in which the amount of fluid refrigerant removed from the refrigerant system during the heating mode is automatically regulated in accordance with the operating requirements of the system, the maximum amount of refrigerant so removed being adjustably predetermined.

An additional object of the present invention to provide an improved charge controlling means which may be readily incorporated into existing heat pump systems of otherwise conventional construction.

In attaining these and other objects, the present invention provides a heat pump refrigeration and heating system including heat exchangers and a compressor in a closed loop refrigerant circuit. The charge balance device is connected in parallel with one heat exchanger to block refrigerant flow in a first direction. The invention also relates to a kit for creating such a system, and the method of operating the system.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
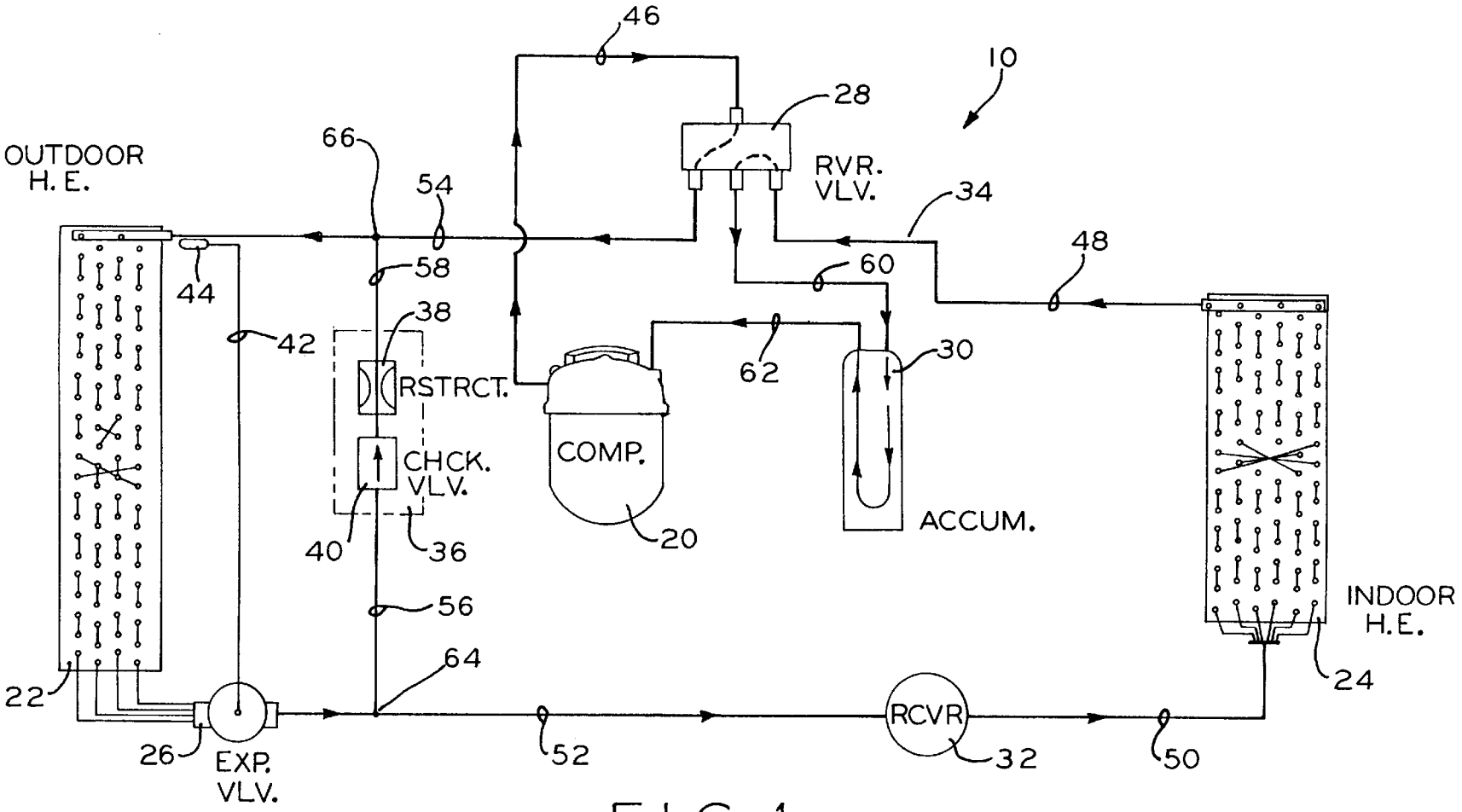
FIG. 1 is a schematic diagram of an improved heat pump system incorporating a preferred embodiment of the present invention, shown during operation of the cooling mode.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, in several forms, and such exemplifications are not to be construed as limiting the scope of the invention in any manner.

DESCRIPTION OF THE INVENTION

The embodiments disclosed below are not intended to be exhaustive or limit the invention to the precise forms disclosed in the following detailed description. Rather, the embodiments are chosen and described so that others skilled in the art may utilize its/their teachings.

The present invention relates to an improved heat pump refrigeration and heating system 10 as shown in FIG. 1, and more particularly relates to charge balance device 36 incorporated into the circuitry of heat pump system 10. Heat pump system 10 is generally comprised of compressor 20, outdoor heat exchanger 22, indoor heat exchanger 24, and refrigerant circuitry 34 which interconnects the components and defines a closed-loop system. Other typical elements of heat pump system 10 include expansion valve 26, reversing valve 28, accumulator 30, and receiver 32.

Heat pump system 10 includes an outdoor heat exchanger 22 and an indoor heat exchanger 24 which may be of any suitable form known in the art. The outdoor heat exchanger is available in several designs such as air coil, water coil, or ground coil. The standard configuration commonly used in a majority of heat pump applications is the air coil design. Likewise, the inside heat exchanger is generally of an A-frame air coil design. In accordance with conventional practice, fans (not shown) are provided to move air over the coils to promote the efficient transfer of heat.

By actuating reversing valve 28 and changing the fluid circuitry, heat pump system 10 can be switched between heating and cooling modes. In the heating mode, the outdoor heat exchanger acts as an evaporator and picks up heat from outdoor ambient air while the indoor heat exchanger, acting as a condenser, releases heat to the controlled temperature environment. Conversely, in the cooling mode, the indoor heat exchanger acts as an evaporator and picks up heat from the controlled temperature environment while the outdoor heat exchanger, acting as a condenser, releases heat to the outdoor ambient air. Expansion valve 26 regulates the amount of refrigerant which traverses heat exchanger 22, and may include tubing 42 and bulb 44 which communicates the discharge temperature of outdoor heat exchanger 22 so the expansion valve 26 may operate in response to the sensed temperature.

Compressor 20 may be any conventional-type compressor, such as a rotary vein, scotch yoke, or scroll compressor. The indoor and outdoor heat exchangers and the compressor are connected in a series arrangement by a refrigerant circuit to define a closed loop system.

In accordance with the present invention, the charge balance device 36 is connected in parallel arrangement with the outdoor heat exchanger. Charge balance device 36 blocks refrigerant flow during the cooling mode of system 10. This blocking function is performed by check valve 40.

In another aspect of the invention, charge balance device 36 throttles refrigerant flow during the heating mode of system 10. This throttling function is performed by restrictor orifice 38.

Figure 4:
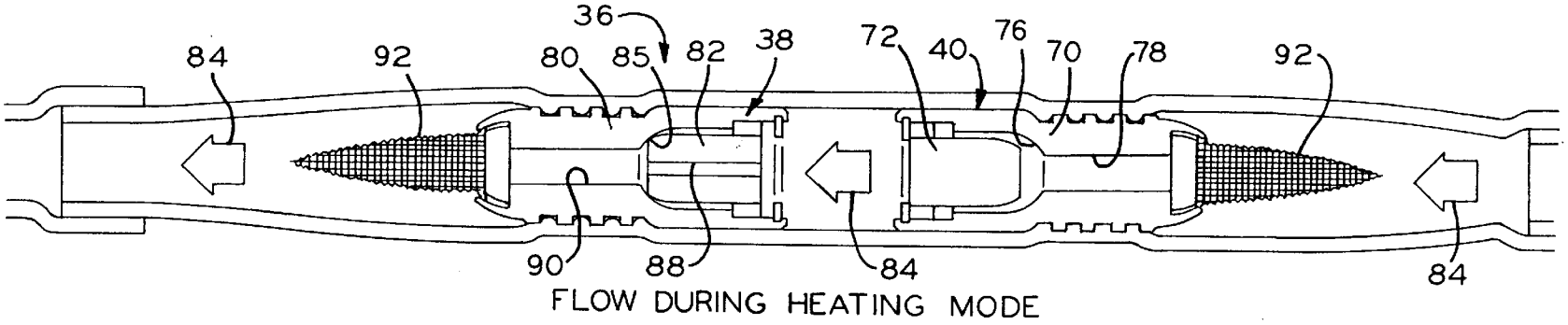
FIGS. 3 and 4 are an enlarged sectional view of the charge balance device of the heat pump system illustrated in FIGS. 1 and 2.
Figure 3:
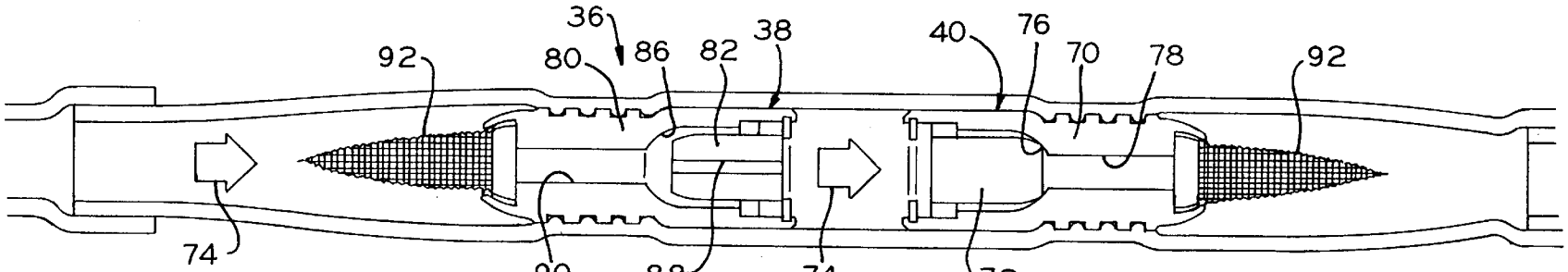

In another aspect of the invention, check valve 40 and restrictor orifice 38 are integrally formed, see FIGS. 3 and 4. In FIG. 3, check valve 40 is shown operating in the cooling mode. Check valve 40 includes distributor housing 70 and plug 72. When refrigerated fluid flows in the direction of arrows 74, plug 72 is urged into shoulder 76 of housing 70, thus blocking passage 78.

In FIG. 4, restrictor orifice 38 is shown operating in the heating mode. Restrictor orifice 38 includes distributor housing 80 and restrictor plug 82. When refrigerant fluid flows in the direction of arrows 84, plug 82 is urged into shoulder 86 of housing 80, thus only allowing fluid flow through narrow opening 88 of plug 82 and passage 90 of housing 80. The amount of refrigerant fluid flow through restrictor orifice 38 may be easily changed by replacing plug 82 with a restrictor plug having a differently sized narrow opening.

Charge balance device 36 is conventionally connected to the tubing of system 10. Charge balance device 36 may optionally include strainers 92 to filter the refrigerant fluid passing through the device. In the exemplary embodiment, charge balance device 36 comprises a dual flow control device manufactured by Aeroquip Corporation of Maumee, Ohio, designated by "FD20" with one of the restrictors replaced by a solid plug.

Accumulator 30 is generally used to store excess refrigerant present during operation of a heating mode. The accumulator is structured and arranged to have capacity to store excess refrigerant in an amount which maximizes the overall operating efficiency of the system during operation of the heating mode. Thus, higher refrigerant charge amounts may be used without causing excessive pressure build-up during operation of the heating mode.

Figure 2:
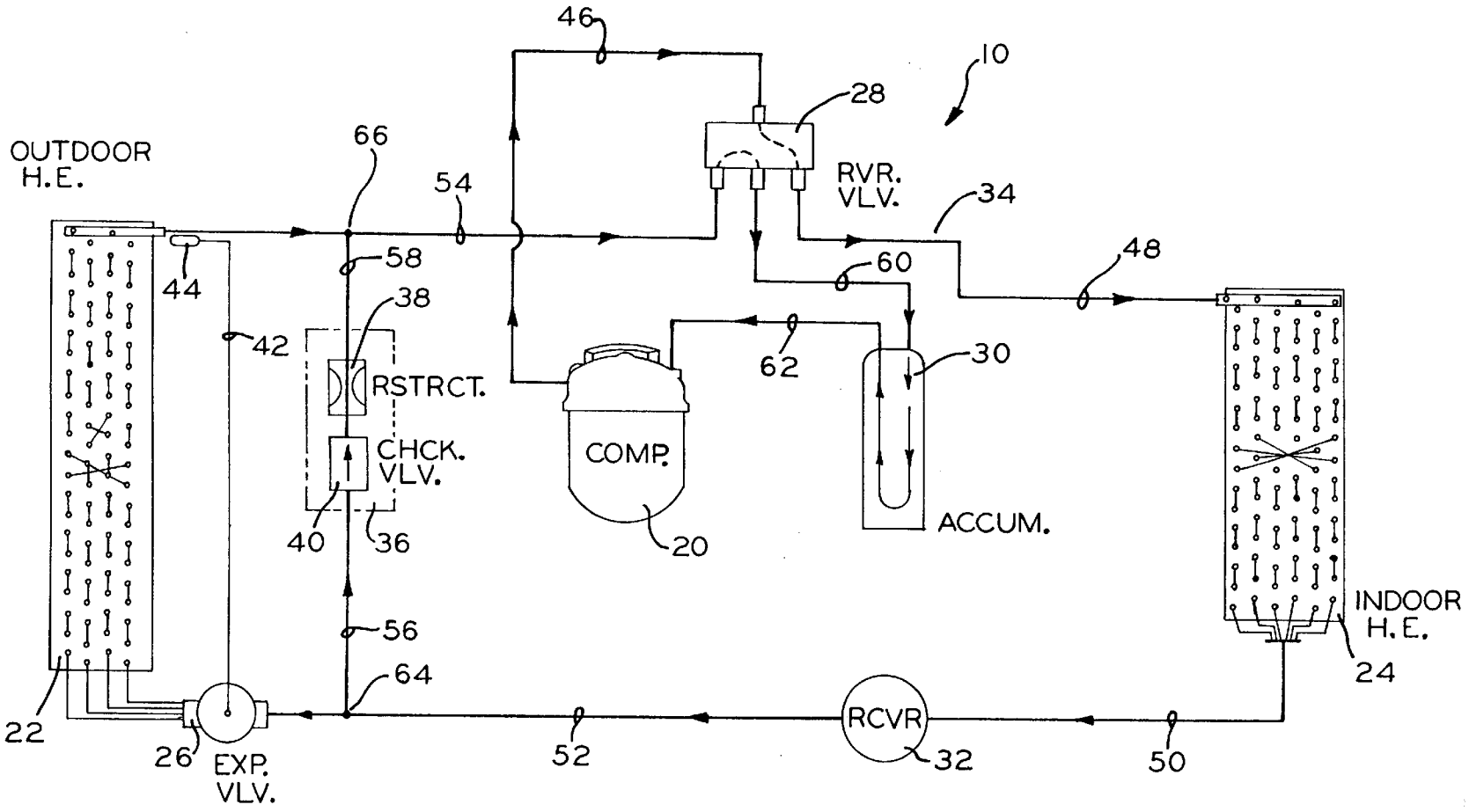
FIG. 2 is a schematic diagram of an improved heat pump system incorporating a preferred embodiment of the present invention, shown during operation of the heating mode.

When reversing valve 28 is configured for the cooling mode (FIG. 1), refrigerant traverses from indoor heat exchanger 24 through tubing 48 and 60 to deliver the gas phase refrigerant fluid to accumulator 30, then through tubing 62 to compressor 20. However in the heating mode (FIG. 2), the gas phase refrigerant fluid traverses from outdoor heat exchanger 22 via tubing 54 and 60 to accumulator 30, and additionally the liquid phase refrigerant fluid traverses tubing 56, restrictor orifice 38, tubing 58, 54, and 60 to accumulator 30, to accommodate higher amounts of refrigerant charge in the heating mode.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A heat pump refrigeration and heating system comprising:

a first heat exchanger;

a second heat exchanger;

a compressor;

refrigerant circuit means connecting said first heat exchanger, said second heat exchanger, and said compressor in a series arrangement and defining a closed loop system;

charge balance means connected in a parallel arrangement with said first heat exchanger relative to said refrigerant circuit means for blocking refrigerant flow in a first flow direction, said charge balance means including a check valve for blocking refrigerant flow in said first flow direction and throttling refrigerant flow in a second flow direction; and said refrigerant circuit means including an accumulator for storing excess refrigerant during operation of a heating mode of said heat pump refrigeration and heating system.

2. The heat pump refrigeration and heating system of claim 1 wherein said check valve is structured and arranged to block refrigerant flow in said first flow direction during operation of a cooling mode of said heat pump refrigeration and heating system.

3. The heat pump refrigeration and heating system of claim 2 wherein said check valve includes a plug freely movable within a refrigerant flow passageway, said plug configured and arranged to allow free-flow of refrigerant in said second flow direction, said plug preventing flow of refrigerant in said first flow direction through seating of said plug against a shoulder disposed within said passageway.

4. The heat pump refrigeration and heating system of claim 1 wherein said charge balance means includes a restrictor orifice for throttling refrigerant flow in said second flow direction.

5. The heat pump refrigeration and heating system of claim 3 wherein said restrictor orifice is structured and arranged to throttle refrigerant flow in said second flow direction during operation of a heating mode of said heat pump refrigeration and heating system.

6. The heat pump refrigeration and heating system of claim 5 wherein said accumulator is structured and arranged to have capacity to store said excess refrigerant in an amount which maximizes overall operating efficiency of said system during operation of said heating mode.

* * * * *